United States Patent [19]

Green

[11] Patent Number: 4,616,375

[45] Date of Patent: Oct. 14, 1986

[54] CLEANING DEVICE FOR JET PIPES IN $TiO_2$ REACTOR

[75] Inventor: Frank Green, Gulfport, Miss.

[73] Assignee: E. I. Du Pont de Nemours and Company, Wilmington, Del.

[21] Appl. No.: 670,973

[22] Filed: Nov. 13, 1984

[51] Int. Cl.[4] ..... B08B 9/02

[52] U.S. Cl. ..... 15/246; 15/104.16

[58] Field of Search ..... 15/104.05, 104.16, 246, 15/246.5; 138/108; 166/170, 176

[56] References Cited

U.S. PATENT DOCUMENTS

| | | | |
|---|---|---|---|
| 2,094,897 | 10/1937 | Leidecker | 166/176 |
| 2,344,758 | 3/1944 | Welsh | 15/104.16 X |
| 4,321,096 | 3/1982 | Dobbin | 15/104.16 X |

*Primary Examiner*—Edward L. Roberts

[57] ABSTRACT

A device for cleaning pipes and the like which comprises a shaft positioned in the pipe, and on the shaft a number of diamond-shaped elements which scrape the inner surface of the pipe as the shaft moves within it.

1 Claim, 2 Drawing Figures

CLEANING DEVICE FOR JET PIPES IN $TiO_2$ REACTOR

DESCRIPTION

TECHNICAL FIELD

This invention relates to a device for cleaning the jet pipes in a reactor for preparing $TiO_2$ by the chloride method. It is more particularly directed to such a device which fits within a jet pipe and cleans it by scraping action.

BACKGROUND

In the chloride process for preparing $TiO_2$, ore is chlorinated in a fluid bed reactor at about 1000°-1200° C. Chlorine gas enters the bottom of the reactor through what are known as "jet pipes." The chlorine is ordinarily fed in as a recycle stream which carries particulate material. These particulates plug the jet pipes after a time.

To maintain a proper flow of chlorine into the reactor, these pipes must be cleaned periodically. This is ordinarily done manually with a rod and a hammer, a job which is not only physically demanding but also dangerous because of the risk of hot reactor contents being discharged through the pipe as it becomes unplugged.

There is, accordingly, a real need for a device which can clean the jet pipes effectively and automatically, with a minimum of human intervention. This need is filled by the device of the invention.

DETAILED DESCRIPTION OF THE INVENTION

Figure 1:
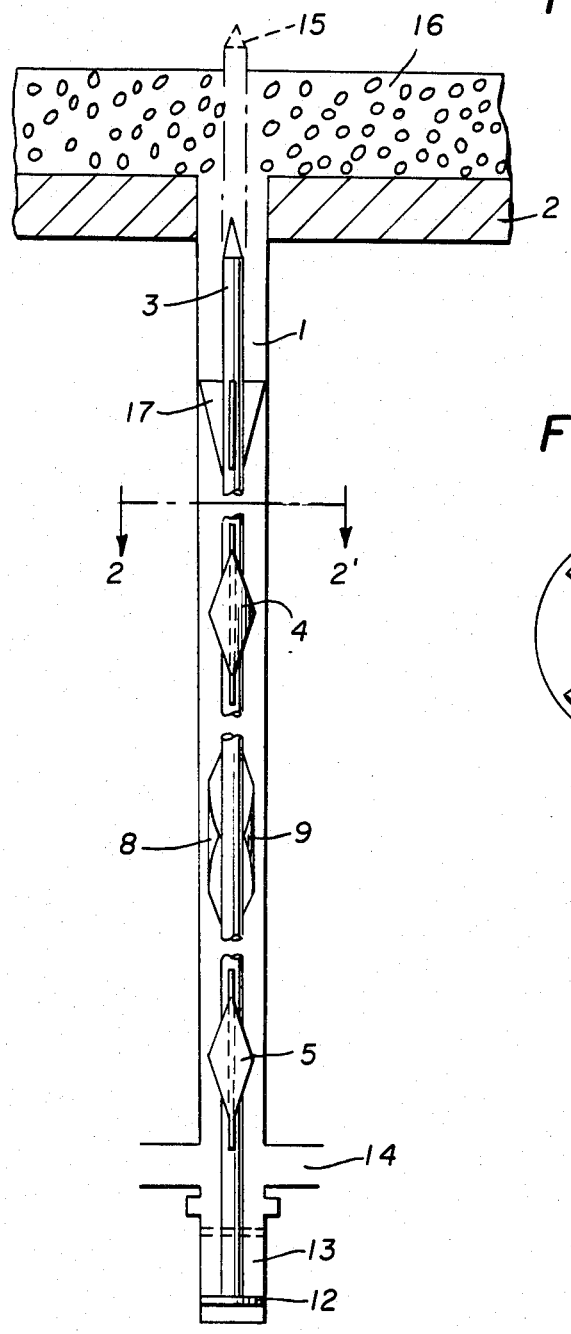
FIG. 1 is a sectional elevational view of a device of the invention.

One will be better able to understand the invention and how it works by referring to the drawings.

Figure 2:
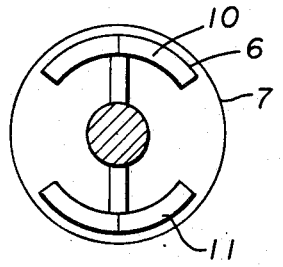
FIG. 2 is a sectional plan view of the device, taken along line 2—2' of FIG. 1.

In FIG. 1, pipe 1 is encased within and projects through the floor 2 of the reactor. Central shaft 3 is fitted within the pipe so that it can slide along the pipe's longitudinal axis. The shaft bears diamond-shaped scraping elements 4 and 5 at intervals along its length. As shown in FIG. 2, the outer surface 6 of each element is arcuate about the longitudinal axis of the shaft, to closely mate the inner surface 7 of the pipe.

Each scraping element has an oppositely mounted partner (8 & 9, and 10 & 11 of FIG. 2). Each such pair is mounted on the shaft ninety degrees about the shaft's longitudinal axis from the pair directly above it.

In operation, the shaft is urged forward in the pipe, as shown by the dashed-line view of FIG. 1, by air pressure applied to the outside of piston 12 within cylinder 13. If desired, this movement can also be achieved manually, mechanically or electrically by means of a solenoid.

As the shaft moves, the scraping elements remove deposits in front of them from the inner surfaces of the pipe. These deposits are carried into the reactor by the stream of chlorine gas entering the jet pipe, and ultimately the reactor, through manifold 14. As the shaft moves forward, its point 15 penetrates the fluid bed of reactants 16 to provide a path for the chlorine and the deposits it carries with it.

The staggered position of the scraping elements on the shaft makes it possible for virtually the whole inner surface of the pipe to be cleaned in one stroke of the shaft.

At the end of the forward stroke, the shaft is urged back to its original position by applying air pressure to the inside of the piston.

The device can be operated manually whenever cleaning is needed, or it can be programmed to clean the pipe at any desired time and at any interval by means of a computer or a conventional electrical or electromechanical timing device.

The elements of the device can be fabricated of any metal capable of withstanding the corrosive atmosphere in the pipes, such as, for example, inconel.

I claim:

1. A device for cleaning a chlorine jet pipe in a chlorine process fluid bed reactor for producing titanium dioxide comprising (a) a central shaft fitted within the pipe to slide along the pipe's longitudinal axis, the shaft bearing a forward point for penetrating the fluid bed, and a plurality of diamond-shaped scraping elements whose outer surfaces are arcuate about said axis to closely mate the inner surface of the pipe, each element having an oppositely mounted partner to form a pair, each pair being mounted 90° about said axis from the pair directly above it, and (b) piston and cylinder means for imparting longitudinal reciprocal motion to the shaft by application of air pressure;

wherein the shaft and scraping elements are fabricated from a metal capable of withstanding corrosion in a chlorine jet pipe atmosphere.

* * * * *